US012589915B2

(12) United States Patent
Nini

(10) Patent No.: US 12,589,915 B2
(45) Date of Patent: Mar. 31, 2026

(54) DISPENSING TAP EQUIPPED WITH FLEXIBLE INTERNAL VALVE

(71) Applicant: VITOP MOULDING S.R.L., Alessandria (IT)

(72) Inventor: Diego Nini, Alessandria (IT)

(73) Assignee: VITOP MOULDING S.R.L. (IT)

( * ) Notice: Subject to any disclaimer, the term of this patent is extended or adjusted under 35 U.S.C. 154(b) by 50 days.

(21) Appl. No.: 18/697,983

(22) PCT Filed: Aug. 8, 2022

(86) PCT No.: PCT/IT2022/050225

§ 371 (c)(1),
(2) Date: Apr. 2, 2024

(87) PCT Pub. No.: WO2023/058072

PCT Pub. Date: Apr. 13, 2023

(65) Prior Publication Data

US 2025/0011045 A1 Jan. 9, 2025

(30) Foreign Application Priority Data

Oct. 4, 2021 (IT) ..... 102021000025367

(51) Int. Cl.
*B65D 39/04* (2006.01)
*B65D 41/28* (2006.01)
*B65D 47/20* (2006.01)

(52) U.S. Cl.
CPC ..... *B65D 39/04* (2013.01); *B65D 41/28* (2013.01); *B65D 47/2037* (2013.01); *B65D 2401/15* (2020.05); *B65D 2539/001* (2013.01)

(58) Field of Classification Search
CPC ..... F16K 15/14; F16K 15/202; B65D 77/067; B65D 2517/0038; B65D 47/30;
(Continued)

(56) References Cited

U.S. PATENT DOCUMENTS 6,050,435 A * 4/2000 Bush ..... B65D 47/2031 222/541.9
9,834,345 B2 * 12/2017 Wieder ..... B65D 47/32
(Continued)

FOREIGN PATENT DOCUMENTS

WO 2019111285 6/2019

OTHER PUBLICATIONS

International Search Report for International Application No. PCT/IT2022/050225 dated Nov. 8, 2022, 4 pages.
(Continued)

*Primary Examiner* — Kareen K Thomas
(74) *Attorney, Agent, or Firm* — Neil G. Cohen; Rohini K. Garg

(57) ABSTRACT

A tap (1) for dispensing liquids from a container is described, comprising a main body (3) adapted to be placed at the dispensing end of the container and comprising an integrated tamper-evident guarantee ring (3.1) which can be removed in a first opening step of the tap (1), a valve (5) inserted between a lower fixing body (4) and the main body (3), including slits (5.2) for the penetration of a dispensing dart (6), the lower fixing body (4) designed to block the valve (5) and allow the correct opening and closing and sealing of the slots (5.2) of the valve (5), and an upper cap (2) mounted on the main body (3) and anchored to the security ring (3.1) integrated in the main body (3).

7 Claims, 17 Drawing Sheets

(58) Field of Classification Search
CPC .... B65D 39/04; B65D 41/28; B65D 47/2037; B65D 2401/15; B65D 2539/001; B65D 2401/10
See application file for complete search history.

(56) References Cited

U.S. PATENT DOCUMENTS

| | | | | |
|---|---|---|---|---|
| 2002/0121531 | A1* | 9/2002 | Stillinger | B65D 47/32 222/525 |
| 2007/0181523 | A1* | 8/2007 | Jackel | B65D 47/2037 215/235 |
| 2008/0093364 | A1* | 4/2008 | Nuotio | B65D 47/2037 220/834 |
| 2010/0176151 | A1* | 7/2010 | Johnson | B65D 77/067 222/542 |
| 2020/0369449 | A1* | 11/2020 | Nini | B65D 39/04 |

OTHER PUBLICATIONS

Written Opinion of the International Searching Authority for International Application No. PCT/IT2022/050225 dated Nov. 8, 2022, 6 pages.

* cited by examiner

DISPENSING TAP EQUIPPED WITH FLEXIBLE INTERNAL VALVE

BACKGROUND OF THE INVENTION

1) Field of the Invention

The present invention relates to a tap for dispensing liquids from containers, in particular the so-called "bag-in-box" containers (hereinafter referred to as BIB).

2) Background Art

The prerogative of the present invention is creating a faucet that is completely made of plastic material (therefore easily recyclable) and that adapts to the various systems (dispensers) present on the market today, effectively replacing/replacing the outdated versions of faucet currently marketed by competitors, who almost exclusively use a very expensive silicone valve and which by its nature (valve with "normally open" hole) cannot guarantee a perfect seal against liquids without the aid of mechanical systems that guarantee perfect sealing.

Furthermore, by replacing this expensive silicone valve, a more attractive system is created on the market, as the total cost of the inventive tap decreases considerably, managing to reach the targets required by the market itself. In this way, the invention provides for a product that guarantees greater product protection both in terms of liquid tightness and in terms of anti-counterfeiting of the product itself, which is a very important issue nowadays.

In addition, there is a dispensing tap that is able to comply and meet the requirements of the new European regulation called "Disposable Plastic" (SUP), recently adopted by the European Parliament, as well as, for example, the AB 319 California Regulation in the United States. Both regulations aim to increase the amount of plastic collected and recycled, thereby reducing marine litter. As a result, Consumer Packaged Goods, CPG, Companies have called on their partners to develop solutions that not only comply with new regulations, but also provide environmentally conscious consumers with solutions that fit their lifestyle and provide them with the best packaging experience.

In the prior art, some valve configurations are known which use the technology consisting of silicone valves with self-closing and self-sealing against liquids that have been on the market for some time, such as, for example, the self-closing valve produced by American company APTAR/LMS Inc., which is, so to speak, the progenitor of this product intended as a flexible self-re-sealable silicone valve.

There are several manufacturers of self-closing silicone valves such as the one produced by APTAR/LMS Inc. (perhaps with small geometric differences) that can be used as part of the faucet to be described. These valves, while functioning correctly, are very expensive and sometimes do not allow the application to enter the market commercially at advantageous prices.

Object of the present invention is producing a tap that allows the use of alternative valves to those in silicone on the market (for example the one supplied by the company APTAR/LMS Inc.) and provides the end customer with a dispensing tap that contains a technology that allows obtaining the same result and the same functionality of the taps now on the market, which use these expensive silicone valves, but give greater guarantees and/or advantages, compared to taps already on the market, of sealing against liquids (when the tap is closed in its storage and/or transport position) and also provide greater guarantees that the liquid inside the container (preferably BIB) has not been counterfeited and/or polluted, due to the multiple anti-counterfeiting systems on the various components of the tap, and above all allow present the tap on the market at a more competitive price (using alternative valves and geometries that contrast the self-wear of alternative airtight valves) compared to those already on the market that use these expensive valves (such as LMS valves).

Currently, there are four manufacturers of closures on the market which contain flexible silicone valves:

1. SCHOLLE IPN;
2. RAPAK;
3. VITOP MOLDING;
4. LIQUI-BOX.

The first three manufacturers use or plan to use the silicone self-sealing valve produced by the company APTAR/LMS Inc. as the "heart" of the system, while the Liqui-Box company uses a different valve (model "DUCK-BILL VALVE" always in silicone) with an integrated system inside to ensure the best self-closing, as this silicone valve alone does not guarantee a perfect self-closing and self-sealing against liquids, which the other valve (valve in silicone LMS) provides.

All companies have filed patent applications, to be precise:

1. SCHOLLE IPN: WO2010/047814
2. RAPAK: WO2016051276
3. VITOP MOLDING: WO2019111285
4. LIQUI-BOX: WO2013033135.

Analyzing the four versions of tap on the market, it can be seen that the first three of these use the valve of the type patented at the time by the LMS company (FIG. 21): in this case, it can be noted that for the SCHOLLE company the main body and upper closing cap have been obtained on the same piece (through a FLAP system) and therefore will necessarily be produced with the same material. This will not give advantages in terms of sealing the tap when the tap is in its closed/transport position, as it will not be possible to create the necessary conditions for obtaining an optimal seal which is instead obtained with the tap of the present invention.

It includes a main body and a top cap, which allow first of all to create two components with different hardness using the same material (one soft and the other hard), which are the basis for having a perfect seal between two plastic components, and also allow obtaining the optimal sealing geometries on the two distinct components. Compared to the tap produced by the RAPAK company, which is composed of different parts divided between them (in particular the RAPAK cap includes three components plus the LMS silicone valve which is common to all caps, namely the main body, the ring and the closing/sealing cap of the cap), the tap of the invention allows adding a "tamper-evident" system, able to highlight the first opening, which the RAPAK tap does not have. In all known taps, once the upper main plug has been removed, which keeps the system closed before the first opening, one only relies on the seal of the silicone valve which, as known, is considered to be of the "normally open" type. those produced with through cuts to ensure the possibility of being opened by dilator darts/pins; therefore, a slight counter-pressure coming from inside the container (in this case BIB) is enough to ensure that the liquid seeps from the slits (notches created ad hoc during the production step of the silicone valve) present on the silicone valve and fluid leakage occurs.

These types of valves rely, for sealing against liquids, on walls created vertically in the notches, making a seal due to the material used (namely, soft silicone) and the geometry of the special notch which is called a "snowflake" cut geometry. The third cap is the one produced by VITOP MOLDING which uses a structure formed by a main body in which a silicone valve (such as the one produced by the company LMS) will be introduced, while, for the liquid tightness of this particular, reliance is made on a having removed the top cap, only and exclusively to the self-sealing system of the silicone valve which, however, being a so-called "normally open" valve, does not guarantee a perfect seal in case of pressure exerted on the container. In this case, to remedy the problem, it was decided to equip the dispenser tap with a cap that also acts as a tamper-evident, which seals the dispenser tap in the various stages preceding the use of the application by the end customer.

The general structure of the cap is maintained, but innovative geometries are envisaged that allow the Applicant to place on the new dispensing tap a valve different from the one used by most competitors, with highly positive results also in terms of tightness even after the first opening by the final customer, and above all at the level of the final price of the application, which today is the major problem of almost all "players" present on the market.

The fourth cap on the market (produced by the LIQUI-BOX company) instead has a slightly different system of use with respect to the previous ones: in fact, once the top cap has been removed, it has a Duckbill model valve which, as known, has even greater sealing problems, so much so that, to facilitate liquid tightness, a particular spring component has been added that helps keeping the flaps of the Duckbill valve closed, which otherwise would not be able by themselves to guarantee a perfect liquid tightness. Therefore, in none of the four taps currently on the market, which use this silicone valve technology, there is a device that allows keeping the tap completely sealed until the first opening in a certain and safe way.

Furthermore, there is only the Applicant's tap (WO2019111285) (with two distinct details) which has a tamper-evident system, which provides evidence of the first opening and allows the end user to see if the cap has been tampered with before the first use, while the others do not have this system with evidence of first opening.

Furthermore, the caps that are placed on the upper part of the dispenser tap (to seal the system) sometimes fail to guarantee an optimal liquid tightness and also to pass the test which then determines the asepticity or not of the dispenser (i.e. the test pressure at 0.5 bar), apart from the tap of document WO2019111285.

On the dispensing taps produced by the RAPAK and LIQUIBOX companies, there are no real tamper-evident systems that provide evidence of any unwanted opening/tampering, in particular of the first opening of the tap. In these two types of dispensing tap, the system (cap) can be opened and closed without the end user noticing that it has been opened.

SUMMARY OF THE INVENTION

On the dispensing tap of the invention, there are multiple tamper-evident systems, which give evidence to the consumer of a possible opening: the first that is created once the two components have been assembled, and the other with jumper systems that will be described in detail below.

The new inventive tap 1 has a further system that allows the end customer to check whether the cap has already been opened, since at the first opening the internal flexible valve 5, guided by the opening bolt 6, moves forward and anchors itself to the lower body 4, due to the internal and external geometries of the lower body 4, providing the final customer with further visual evidence, in addition to the multiple tamper-evident systems present on the other elements of the cap, of a first opening.

Furthermore, the tap 1 according to the invention allows realizing a dispenser which allows having a very high oxygen barrier, due to the new mechanical systems created on the lower body 4 which, cooperating with the flexible valve 5, increase the general "tightness" of the tap 1 before and after the first opening.

A further object of the present invention is therefore producing an innovative simple and "eco-friendly" tap, which however allows it to be adapted to the systems available on the market without requiring a modification.

The tap of the invention is able to adapt without problems to all versions of dispensing pins and connectors on the market.

Subsequently, an insertion dart 6 present on the market today will be shown, in a completely generic way, which in any case summarizes geometrically what is found (connectors and penetration bolts) on the market today.

Analyzing the opening steps of the three dispensers on the market, it can be summarized that:

- STEP 1: OPENING/REMOVING THE PROTECTIVE CAP. In this case, only the SCHOLLE and VITOP MOLDING dispensers are equipped with a tamper-evident which clearly and irrefutably highlights the opening;
- STEP 2: as regards the SCHOLLE and LIQUI-BOX regulators, the protective flap must be opened, which is made in one piece with the main body, while for VITOP MOLDING and RAPAK a cover component must be removed to part. From this stage onwards, we rely on the seal of the silicone valve which, as mentioned before, being a silicone component with a cut (APTAR/LMS use a special patented cut called "Snoflake"), could be opened due to pressure on the container;
- STEP 3: Inserting the container on the dispensing machines (usually they are equipped with a removable tray where the spout will be anchored (if it is a BIB) in the appropriate seat. In this case, for example, by manipulating the bag (in the case of BIB), it could cause that pressure that can open the silicone valve and create a liquid leak);
- STEP 4: Inserting the dispensing pin of the machine into the dispensing tap and opening the silicone valve with subsequent dispensing of the product contained in the container itself;
- STEP 5: Removing/changing the container and restarting from STEP 1.

A further object of the present invention is creating a cap that allows the use of alternative flexible valves and if desired, since the sealing of the flaps created on the flexible component is carried out due to the mechanical action created due to the geometries present on the lower body, with flexible materials also alternative to silicone, without having to use the expensive silicone valves with Snoflake cut produced by the company LMS/Aptar, due to the study and creation of geometries that help and enable a mechanical self-closing without having to use additional components of the spring type, as happens on the version produced by the LIQUI-BOX company and described above.

A further object of the present invention is eliminating the negative effect of the cut flexible valves which are "normally open" due to geometries present on the lower body 4, which will help to keep the cut edges of the valves 5 sealed at all times, without having to use an additional spring component as it happens on LIQUI-BOX caps.

A further object of the present invention is providing a tap as described above which achieves a perfect seal against liquids and aseptic test-proof, ensuring a perfect seal when the tap is in its closed and/or transposed position, and until the top cap will be removed due to the use of different materials and correct component geometries.

A further object is providing tamper-evident and anti-counterfeiting systems which give evidence of the removal of the top cap, due to the cooperation of various geometries once the tap has been assembled.

A further object is creating a dispenser where all components are placed in the rear part of the dispenser, thus obtaining a significant decrease in oxygen entering the bag (in case of using a BIB container), as the space that is normally occupied by air is occupied by the components that form the cap.

A further object of the present invention is constraining two components (main body and rear body) due to different technologies. The main one will be the interlocking technology, where the necessary geometries are created that are useful for the stable interlocking between the two components and for locking them to avoid inadvertent disassembly of the dispenser cap 1.

A further object of the present invention is designing a geometric rear sealing mechanism which cooperates with a flexible valve and allows an increase in the oxygen barrier. Furthermore, a significant decrease in the amount of oxygen that goes inside the bag is obtained, once it has been filled, as all system components are housed on the back of the cap with respect to the delivery area, thus occupying that volume. which is normally free and therefore full of air, as on known taps on the market.

A further object of the present invention is providing a tap as mentioned above which is equipped with a tamper-evident security seal both on the top cap and, above all, on the main body. When the tap is assembled, the top cap anchors to the ring on the body and creates a double anti-counterfeiting tamper-evident sealing system, which irreversibly highlights its opening once opened, and keeps the components in position during the various production stages when it is in the closing step.

The inventive tap, being equipped with a high oxygen barrier, is suitable for aseptic applications.

A further object of the present invention is creating details that are easy to produce during the molding phase and easy to assemble so as to reduce production costs to a minimum.

The aforementioned and other objects and advantages of the invention, which will emerge from the following description, are achieved with a dispensing tap as claimed in claim 1. Preferred embodiments and non-trivial variants of the present invention are the subject matter of the dependent claims.

BRIEF DESCRIPTION OF THE DRAWINGS

The present invention will be better described by some preferred embodiments, provided by way of non-limiting example, with reference to the attached drawings, in which.

DETAILED DESCRIPTION OF PREFERRED EMBODIMENTS

An embodiment of the tap 1 according to the invention will be described below, based on the method used for the permanent fixing between a main body 3 and a lower body 4, that is by means of interlocking between the various components (which will be the main and favorite embodiment). It goes without saying that any other method of conformation and connection between the elements (welding, screwing, etc.) falls within the scope of protection of the present invention.

Figure 13:
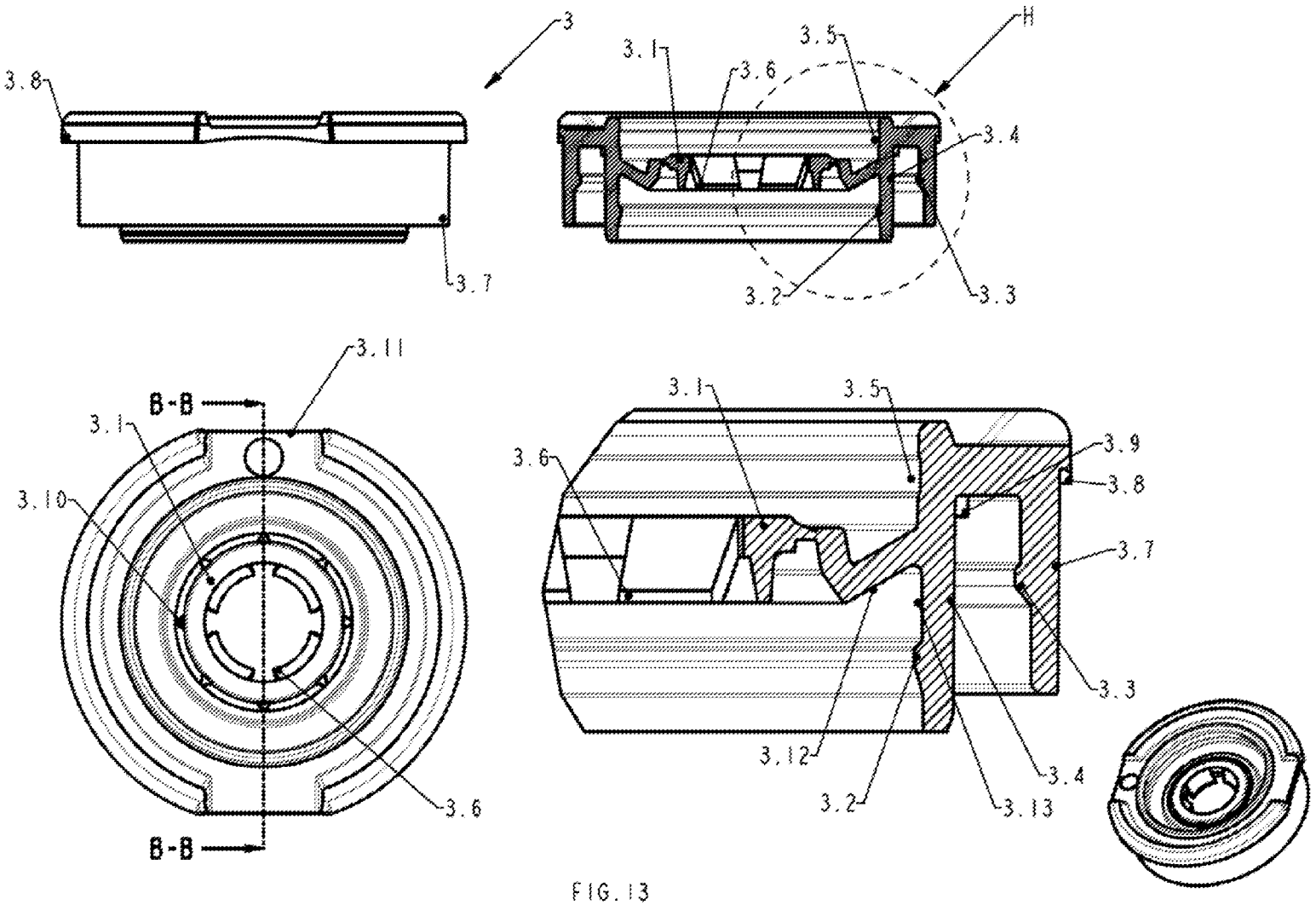
FIG. 13 is a top, side, sectional, isometric and detailed view of the body 3 of the inventive tap 1.
Figure 15:
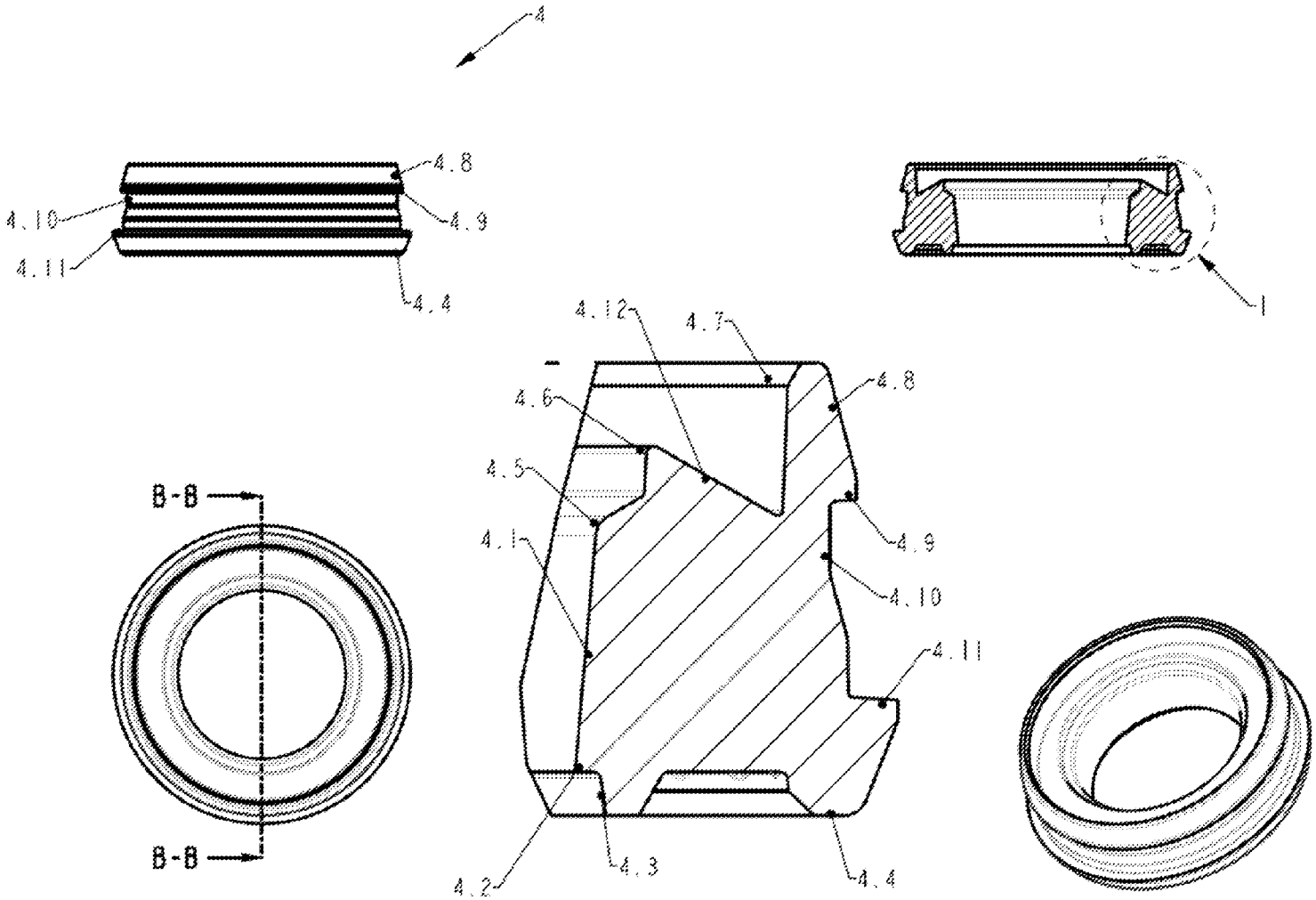
FIG. 15 is a top, side, sectional, isometric and detailed view of the lower body 4 of the inventive tap 1.

In summary, the embodiment of the tap 1 for dispensing liquids according to the invention will be described, resulting from the coupling of the components listed below:

- a main body 3, shown in FIG. 13, to be coupled, preferably by interlocking, with a lower fixing body 4, shown in FIG. 15. A flexible valve with a central opening with notch is stably placed between the two aforesaid components. Above the main body assembly 3—flexible valve 5—lower body 4, a cover cap 2 is placed to protect the assembly itself and to allow heat and aseptic treatments.

It will be evident to a skilled person in the art that the described tap can be made in shapes, sizes and with equivalent details, and can be used for containers of various types, for example those so-called "Bag-in-Box", but also rigid or semi-rigid containers and the like.

Figure 7:
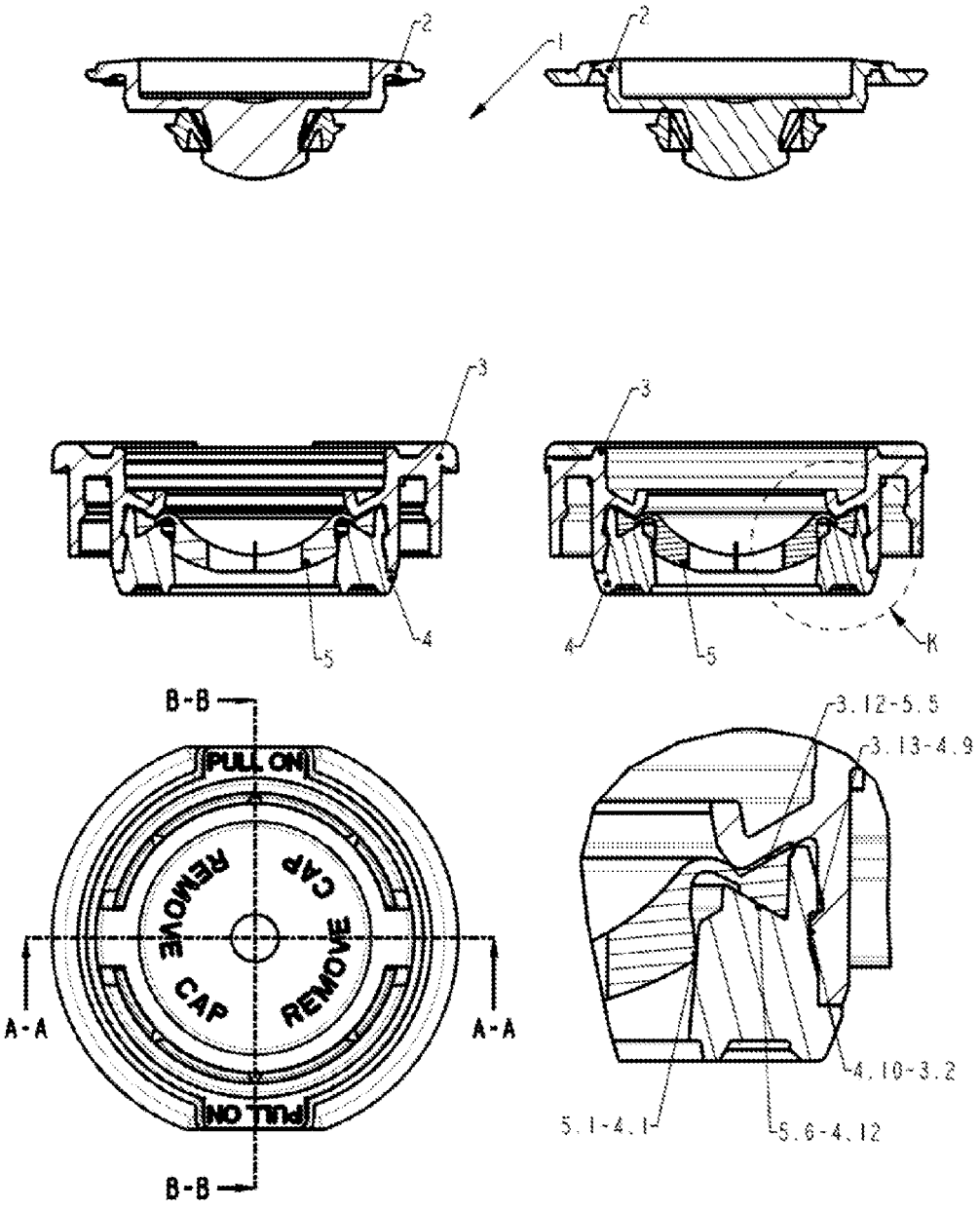
FIG. 7 are a top view and two side-sectional views in detail of the embodiment of the tap according to the present invention in STEP 1, when the upper guarantee seal 2 is removed and the inventive tap is ready to be connected to the dispensers.
Figure 10:
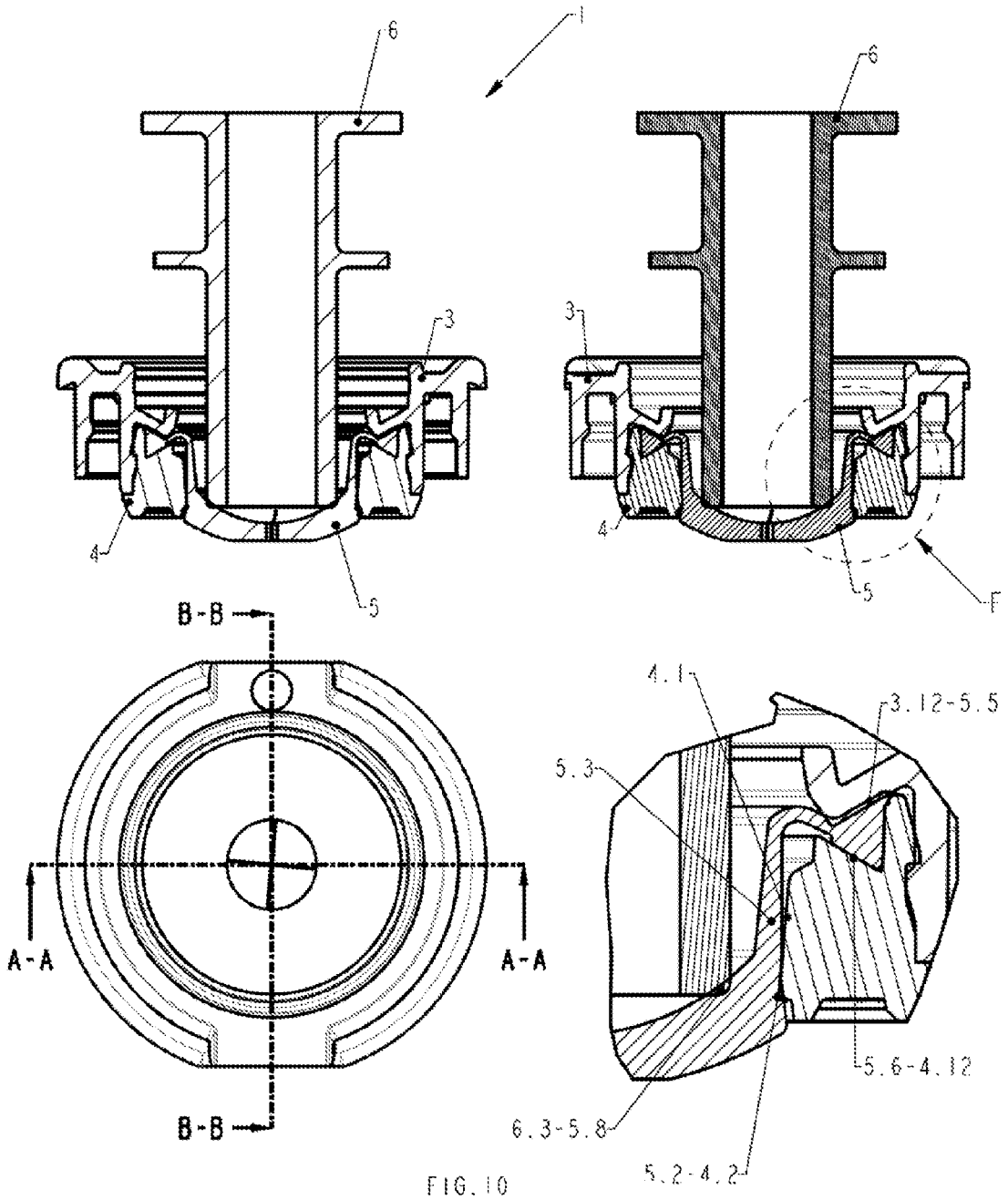
FIG. 10 are a top view and two side-sectional views in detail of the embodiment of the tap according to the present invention in STEP 4, when the dart/pin 6 has pushed and stretched the flexible valve 5 to the maximum position, anchoring it to the geometries of the lower body 4 and generating the maximum sealing force between the flaps (which would normally be open) of the flexible valve.
Figure 11:
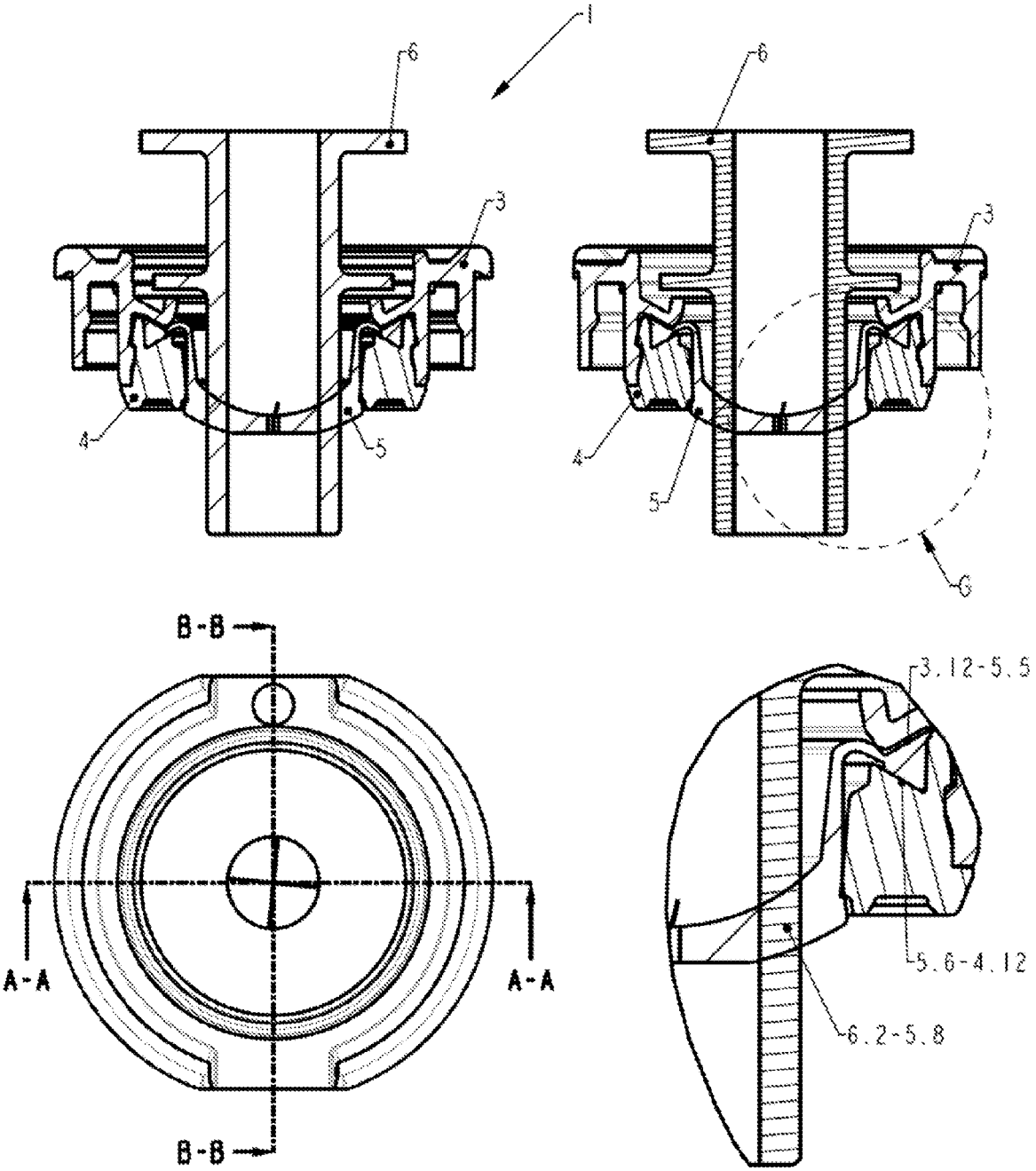
FIG. 11 is a top view and two side-sectional views in detail of the embodiment of the tap according to the present invention in STEP 5, i.e. of complete opening of the flexible valve 5, due to the complete penetration of the dart/pin 6 and to the subsequent opening of the valve flaps 5.
Figure 12:
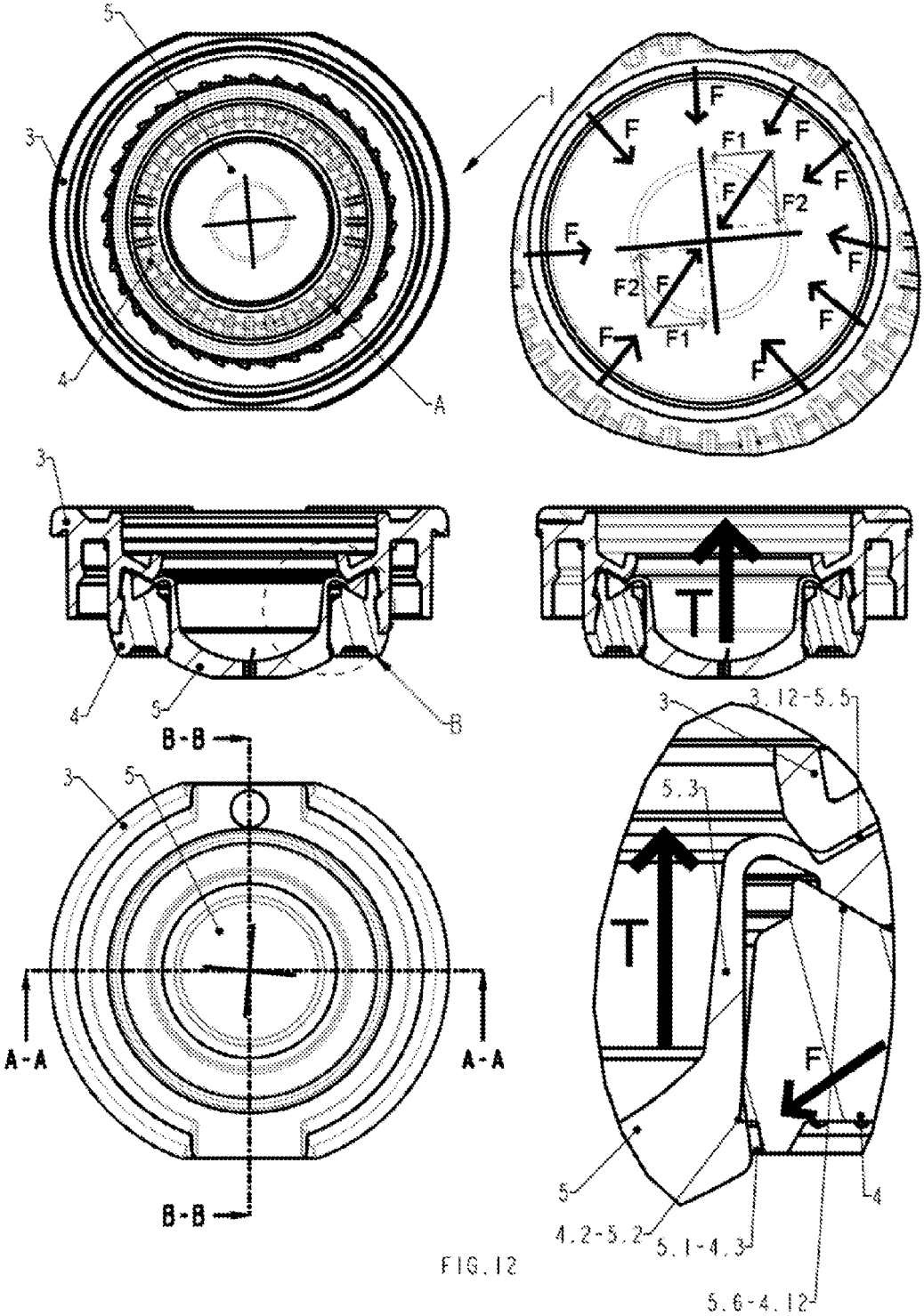
FIG. 12 is a top view and two side-sectional views in detail of the embodiment of the tap according to the present invention in STEP 6, when the dart/pin 6 is removed and the valve 5 returns with the flaps in the hermetic closing phase, due to the action of the pulling force T of the valve 5 which generates an opposite circumferential force F on the outside of the valve, which creates force vectors acting on the same flaps F1 and F2 which determine a hermetic seal and effectively cancel the weak cut point of these flexible valves, that is to always be "normally open" without having to use an additional spring component.
Figure 16:
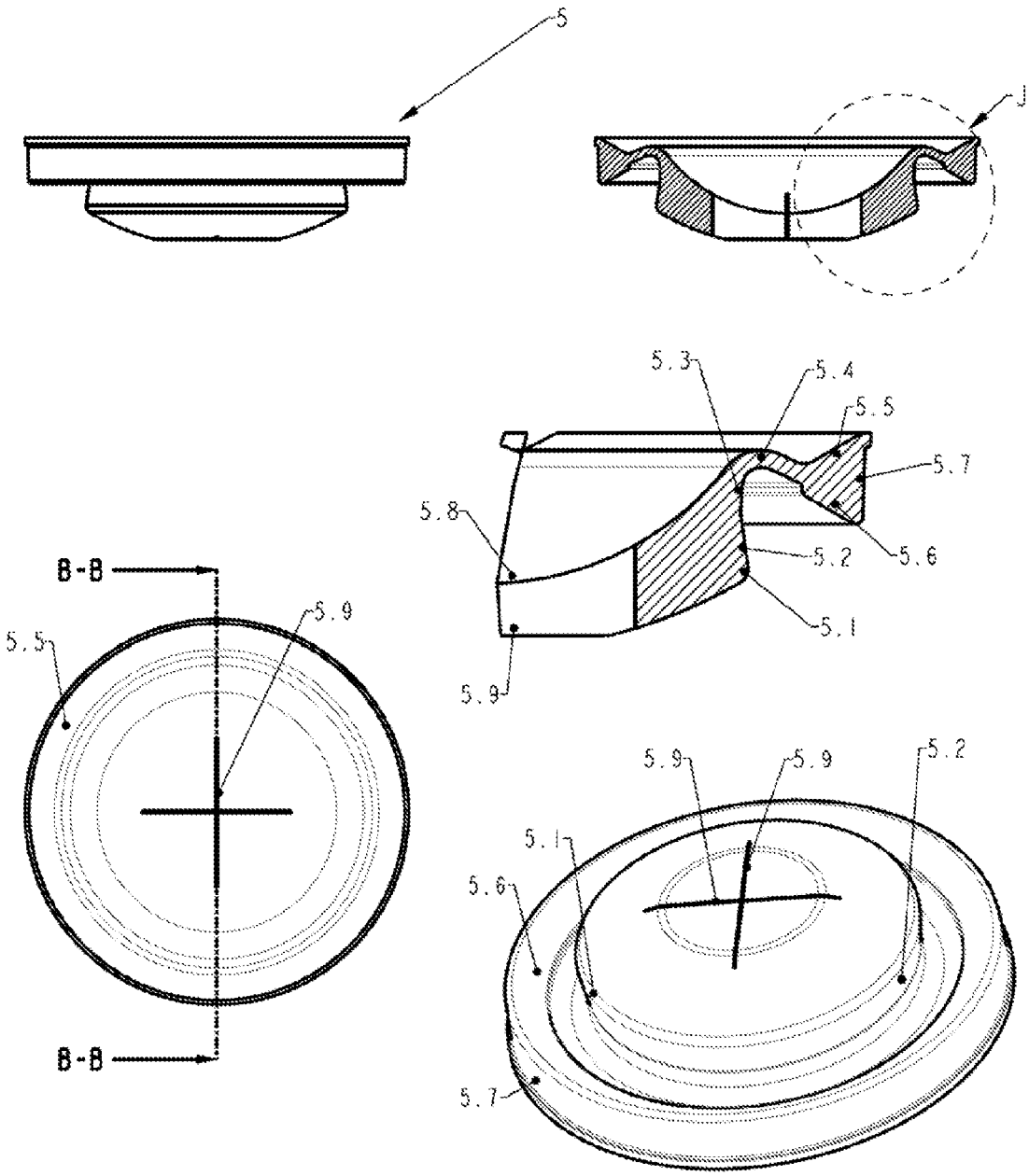
FIG. 16 is a top, side, sectional, isometric and detailed view of the flexible internal valve 5 with standard cross cut of the inventive tap 1.
Figure 17:
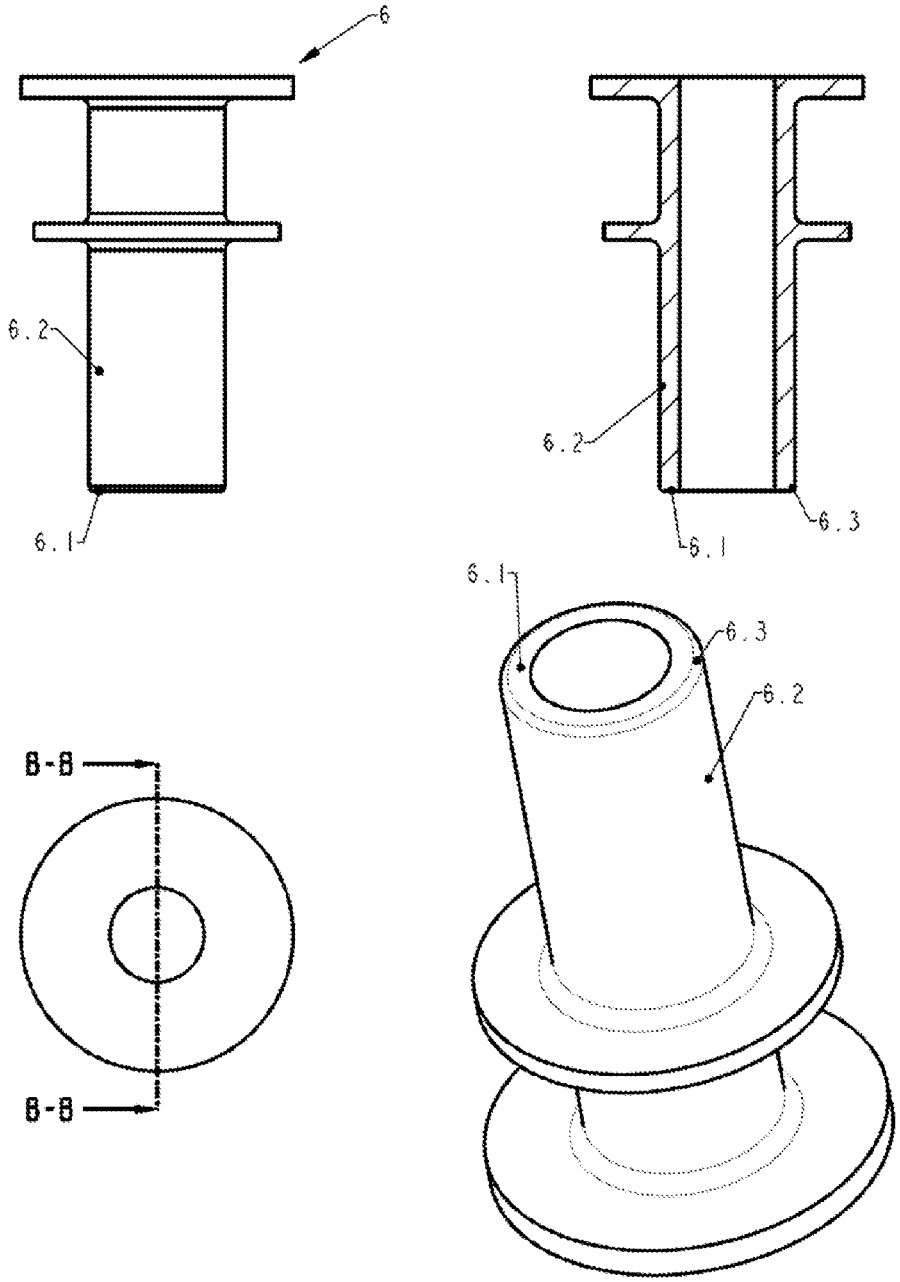
FIG. 17 is a top, side, sectional, isometric and detailed view of the insertion dart/pin 6 drawn in a generic way to summarize those on the market used for opening the valve 5 of the inventive tap 1.

The tap 1 of the invention is used for dispensing liquids from a container (not shown) by means of the operative insertion of a dart/pin 6 of FIG. 17, and substantially comprises:

- the main body 3 (better shown in FIG. 13) equipped with a central guarantee ring/seal (1st tamper-evident element) 3.1, and with anchoring means 3.2 for anchoring to the lower body 4 (better shown in FIG. 15) by means of a coupling tooth 4.9 (FIG. 15) and a coupling tooth 3.3 (FIG. 3), which allow the tap 1 to be placed at the dispensing end of the container (rigid, semi-rigid or flexible type BIB) on the connection nozzle to the flexible bag (not shown). The main body 3 is also equipped with a coupling seat 3.5 useful for allowing the connection with the top cap 2 of FIG. 14 due to the ring geometry 2.3;
- a flexible valve 5 (better shown in FIG. 16), preferably in silicone, to be produced with known resin injection and/or compression molding systems to reduce production costs, and equipped with slits/flaps 5.9 created after molding. The valve 5 is formed by an external fastening ring which has an upper surface 5.5 and a lower surface 5.6, which are respectively to be coupled with the surface 3.12 of the main body 3 (coupling 3.12-5.5) and the surface 4.12 of the lower body 4 (coupling 5.6-4.12). The valve 5 has an area that allows controlled elongation 5.4 (FIG. 16) and an anchoring area 5.2, which then goes into coupling with the tooth 4.2 of FIG. 15 of the lower body 4, blocking the valve in extension/pulling and generating that force T which will then be transformed into force F in FIG. 12, opposite to force T, and in a circumferential position, which then allows the decomposed vectors F1 and F2 of FIG. 12 to provide a sealing force necessary for the cut edges 5.9 of the valve flexible 5 (effectively transforming it from a "normally open" valve to a "normally closed" valve). The valve 5 is also equipped with a static sealing surface 5.1 through cooperation with the surface 4.1 when the tap 1 has not yet been activated for the first time (FIGS. 7, 8 and 9) A cut will be made on the central part, which can be a cross, and will be the area that will allow the passage and holding of the dart/pin 6 as shown in FIG. 11;
- the lower fixing body 4 (better shown in FIG. 15), conformed with an external coupling system 4.9 and a facilitating system 4.8 for correct assembly, in order to stably block the flexible valve 5 to the main body 3. A lower seat is created 4.12 in order to have an anchoring abutment area which pushes, once assembled to the main body 3, the flexible valve 5, providing a correct sealing interference and thus allowing all the activation phases of the system shown in FIGS. 7, 8, 9, 10, 11 and 12. A stable and no longer demountable assembly is created. On the lower body 4 there are the geometries 4.1, 4.2 and 4.3 (FIG. 15) which allow the flexible internal valve 5 to move, pushed by the dart/pin 6 as shown in FIGS. 9, 10 and 11, moving on the inclined plane 4.1 and increasing more and more the circumferential force acting on the surfaces of the slits/flaps 5.9 of the flexible valve 5 until the "climbing over" of tooth 4.2 (shown in FIG. 15) and therefore the subsequent release of the flaps from the circumferential vector force F of FIG. 12, and the consequent possibility of the dart/pin 6 to widen the slits 5.9 of FIG. 16. This allows the delivery of liquid and the sealing of the same dart/pin 6 by means of the external surfaces 6.2 of FIG. 17 for engagement on 5.8, as also shown in FIG. 11. Once dispensing is complete and once the dart/pin 6 has been removed, the flexible valve 5 remains anchored to the lower body 4, due to the geometries 4.2 and 4.3 of FIG. 15, and the condition shown in FIG. 12 occurs: in this case, the end user has a second evidence (2nd tamper-evident system) (after removing the tamper-evident ring 3.1 from body 3 as shown in FIG. 7) of the first opening of the tap 1, as the flexible membrane 5 appears visually in the operating pull/elongation position, as shown in FIG. 12. In this condition highlighted in FIG. 12, the flexible valve 5 is in elongation, blocked by the geometries 4.2 and 4.3 of FIG. 15 and, taking advantage of its elasticity and its natural predisposition to return to the "original rest" position, generates a force tension T, which generates on the flexible valve 5 (the front part) a circumferential stress F which allows the valve 5 itself to generate the force vectors F (FIG. 12), i.e. the vectors F1 and F2, acting in the opposite way on the faces of the flaps 5.9, to keep these slits 5.9 sealed, obtained by a cut on the flexible valve 5 (which otherwise would remain open). The force F is the force that is generated due to the flexible valve 5 in pull T of FIG. 15. These resulting F1 and F2, acting in the opposite way on the flaps 5.9, favor the sealing of the same at all times and transform a "normally open" system into a "normally closed" system, increasing the general seal of tap 1, and without using an additional component, as occurs for example on the tap produced by LIQUIBOX (elastic spring added). This "mechanical" closure generated by the natural pull T of the elastic valve 5 blocked/wedged on the lower body 4 due to the geometries 4.2 of FIG. 12 generates the circumferential force F which in turn generates the vectors F1 and F2, and also has another notable advantage, namely that of not necessarily having to use a silicone valve, which in any case remains preferential for the application, but of being able to also use other flexible materials on the market, thus reducing the cost of the same and consequently guaranteeing entry on the competitively priced market for the inventive tap 1;
- the top cap or top cap 2, preferably with integrated guarantee seal and flexible handles (3rd tamper-evident system) which provides another evidence to the customer, in addition to the two previously exposed, for easy removal of the same during the first opening, which serves to create the global tamper-evident system, once mounted on the main body 3, and anchored to the tamper-evident ring 3.1, integrated in the body 3.

Figure 1:
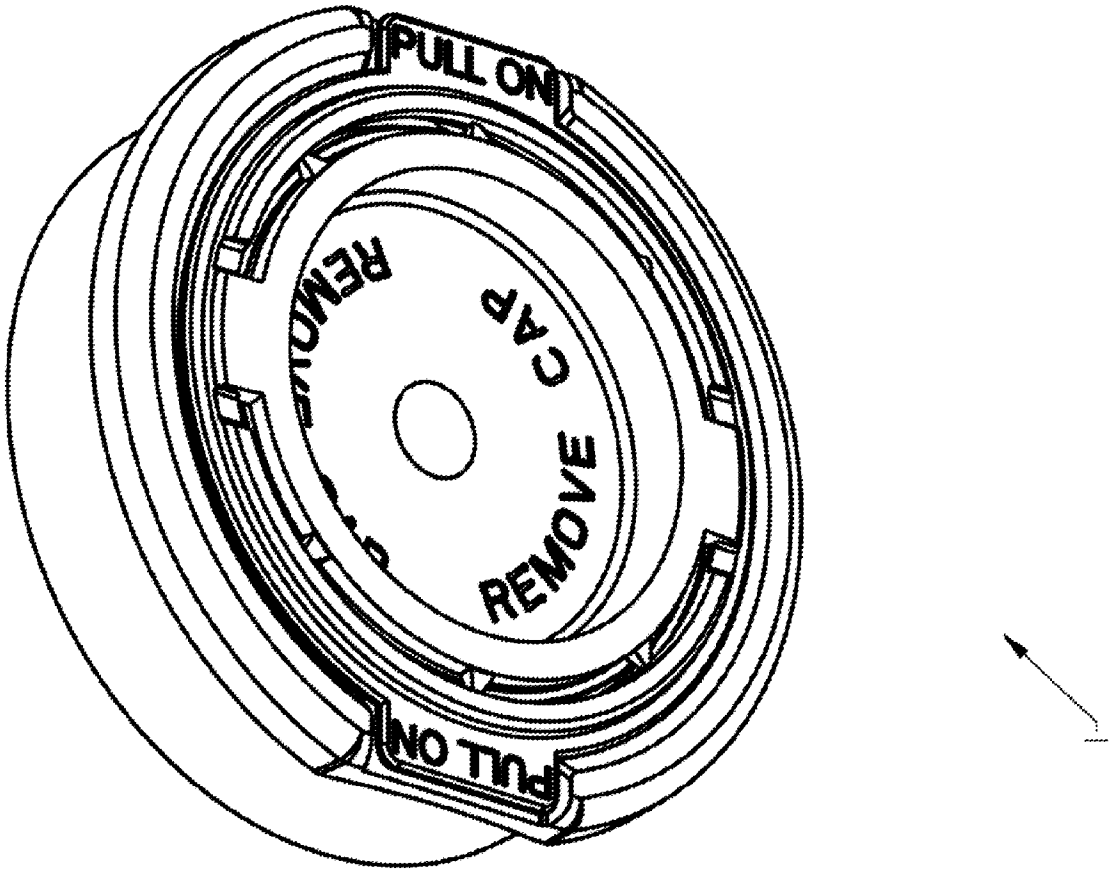
FIG. 1 is a perspective view of an embodiment of the tap according to the present invention.
Figure 2:
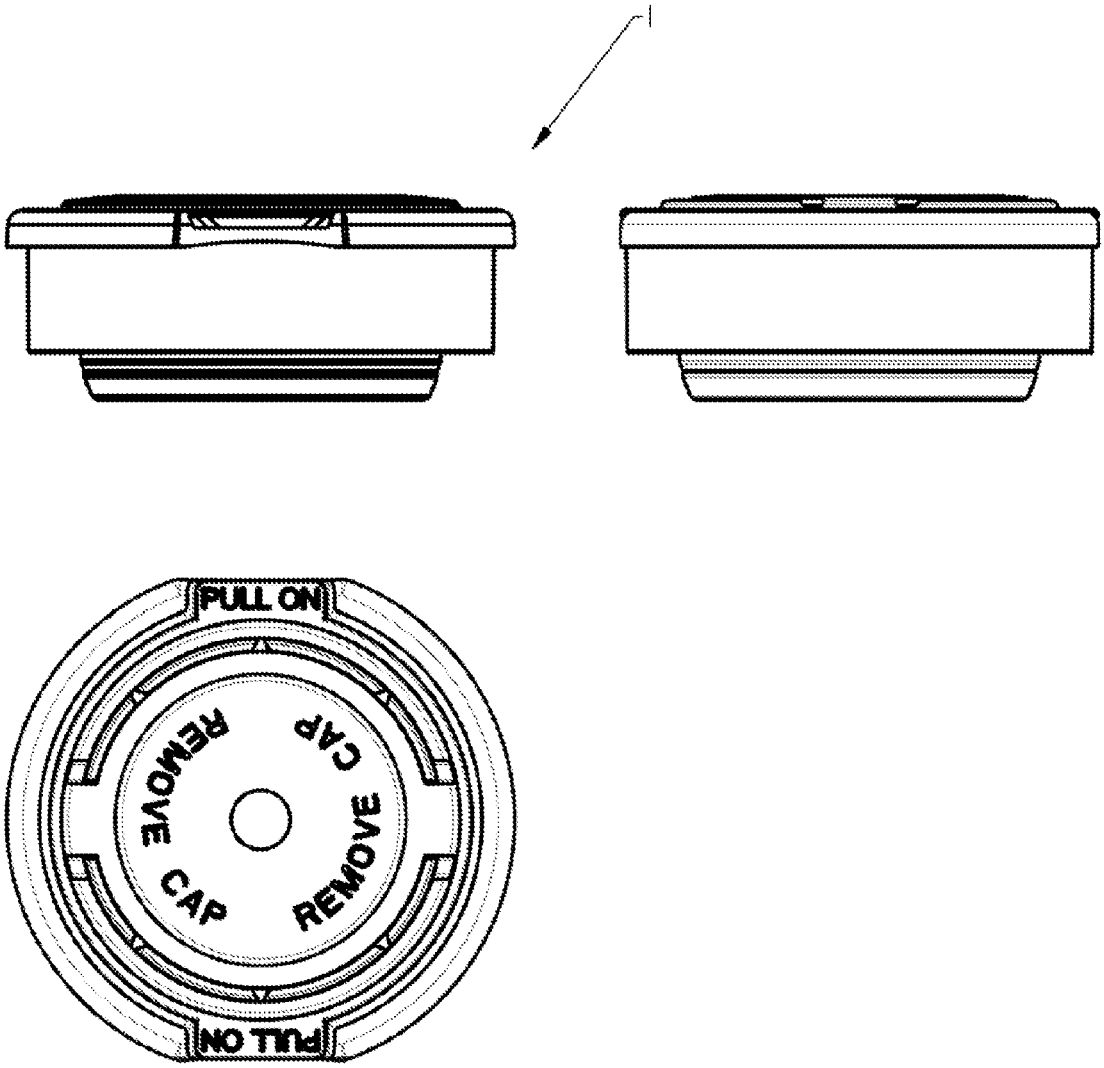
FIG. 2 are two side views and one top views of the tap according to the present invention.
Figure 3:
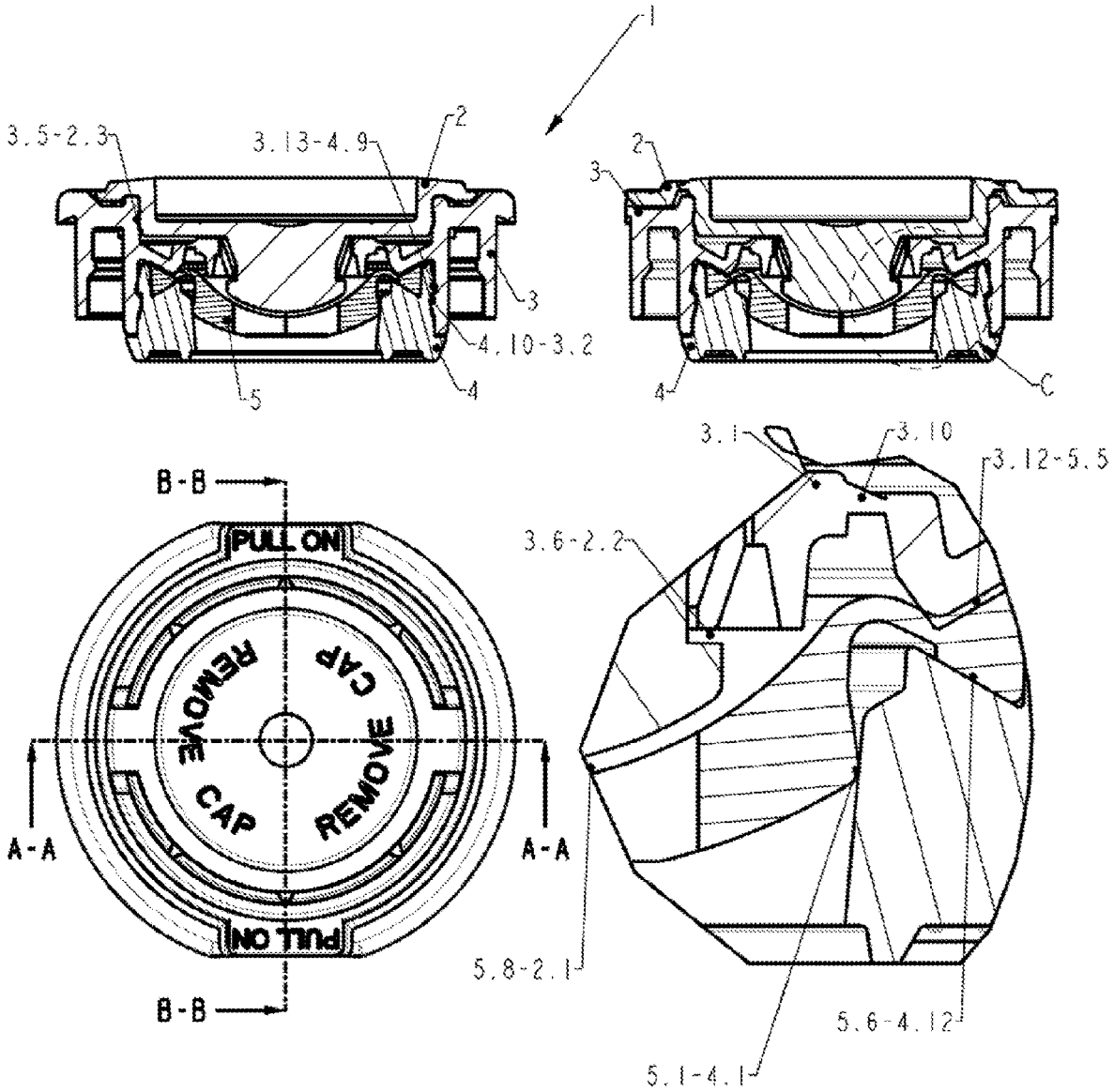
FIG. 3 are a top view and two sectional views of the assembled tap of FIG. 1 in the completely closed position.
Figure 4:
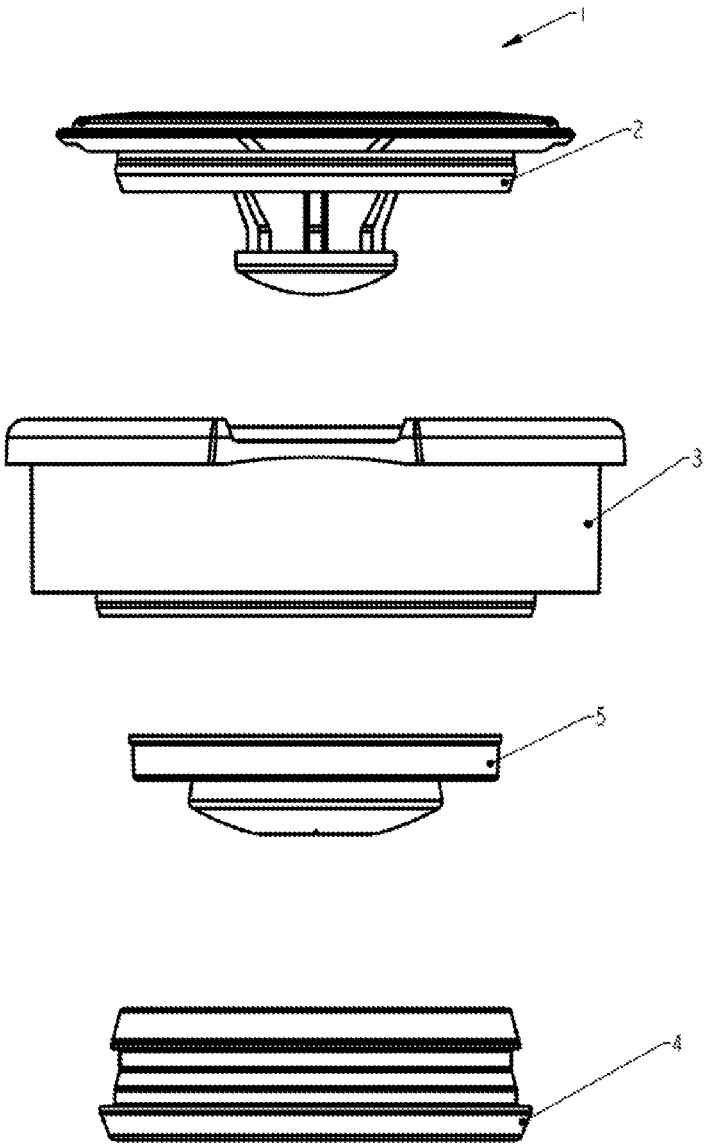
FIG. 4 is an exploded view of the tap of the invention of FIG. 1.
Figure 5:
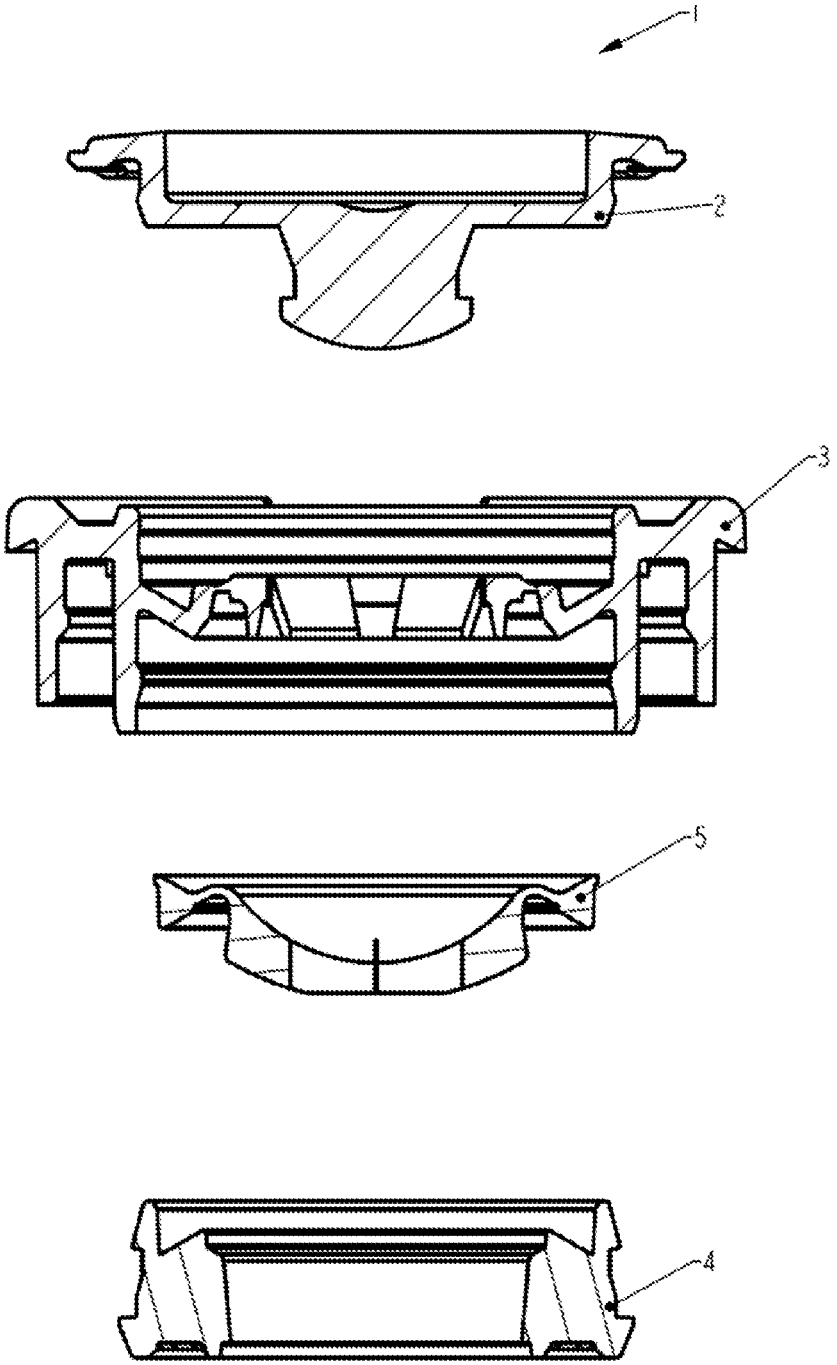
FIG. 5 is an exploded sectional view of the tap of the invention of FIG. 1.
Figure 6:
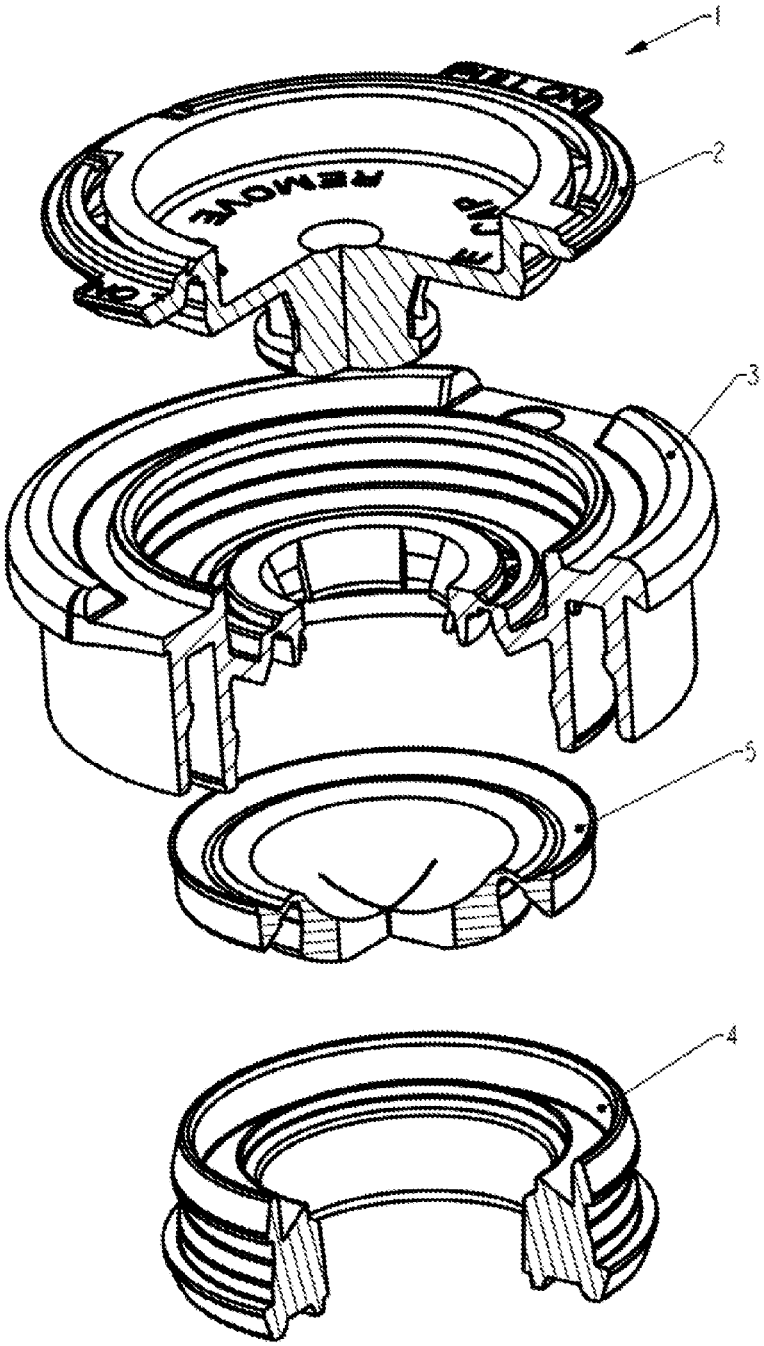
FIG. 6 is a sectional isometric exploded view of the inventive tap 1.

In its main configuration shown in FIGS. 1 to 16, in detail, referring to FIG. 3, the section of the tap 1 of the invention can be identified, assembled and in its closed and transport position in its preferred configuration.

In particular, reference is made to FIGS. 3, 7, 8, 9, 10 and 11, where the various stages are shown, of opening the inventive tap 1 and then removing the dart/pin 6 and the subsequent configuration after the first opening shown in FIG. 12.

In particular, with reference to FIG. 3, the tap 1 can be seen in section and in its closed position with the upper cap 2 assembled.

The main body 3 is equipped with internal coupling geometries 3.2 (FIG. 13) and with an abutment plane 3.12 towards the flexible valve 5, as well as with a vertical seat 3.13 for containing the flexible valve 5, which allows the valve 5, preferably made of silicone, to be inserted and remain locked in the correct assembly position until the lower body 4 of FIG. 15 is placed at the rear, preferably interlocking. The tamper-evident ring 3.1 integrated in the main body 3 is also obtained due to breaking bridges 3.10 (FIG. 13) which fits stably on the top cap 2 by means of the geometries obtained on the central pin 2.2 (FIG. 14), binding to it stably and forming the second tamper-evident system present on the tap inventive 1. The top cap 2 will be provided with integrated handles 2.6 and constrained by means of breaking teeth 2.5 (which are the first tamper-evident system present on the inventive tap 1) These teeth are designed to break and free the two handles 2.6 (FIG. 14) present on the top cap 2, and can make a 90° overturn (each of them), not shown in the drawings, which allows the end user to have a comfortable grip on the top cap 2 to be able to apply the force necessary to remove the top cap 2 itself, which is bound to the tamper-evident ring 3.1 of the main body 3, and to overcome the interference force that exists between the seat 3.5 of the main body 3 and the ring 2.3 on the top cap 2, effectively freeing the tap 1 from the top protection, as shown in FIG. 7.

Always analyzing the situation of the completely closed cap 2 in FIG. 3, it can be seen that on the rear part, in addition to the flexible valve 5, the lower body 4 is also stably placed, which pushes, due to the internal plane 4.12 (FIG. 3), on the lower part of the valve 5, thus creating a correct interference that stably blocks the flexible valve 5 in the middle of the main body 3 and the lower body 4 (3.12-5.5 and 5.6-4.12 in FIG. 3). The lower body 4 is stably assembled due to the geometries 4.9 of FIG. 15 with the geometries 3.2 present on the main body 2 of FIG. 13, stably constraining and locking the flexible valve 5 which is located between the main body 3 and the lower body 4, as shown in FIG. 3. To finish the analysis of the inventive tap 1 of FIG. 3, in its completely closed and still inviolate position, it can be noted that the upper cap 2, when mounted on the main body 3, supplies the internal valve 5 with a flexible semi-spherical support surface 2.1 which further keeps the valve 5 in its closed position and prevents its opening due to pressures coming from the inside of the container, due to the coupling of the surface 5.8 of the valve 5 and the surface 2.1 of the top cap 2, as highlighted in the detail of FIG. 3.

Figure 14:
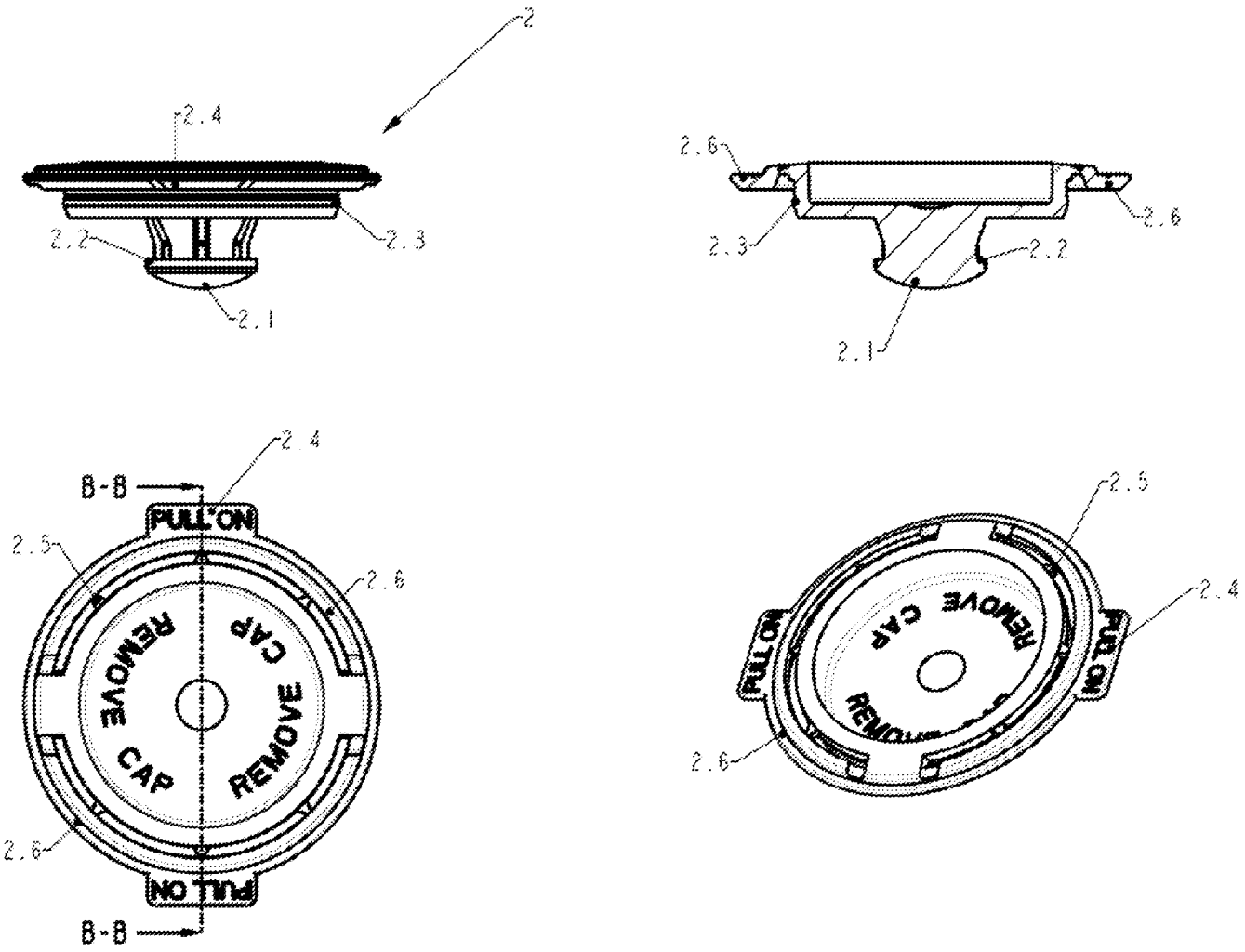
FIG. 14 is a top, side, sectional, isometric and detailed view of the over-cap 2 of the inventive tap 1.

FIG. 7 shows the dispensing tap 1 when the top cap 2 is removed, effectively breaking the first two tamper-evident systems present on the tap 1, i.e. the tamper-evident ring 3.1 of FIG. 7 and the jumpers 2.5 of FIG. 14 of the handles 2.6 of the top cap 2.

Figure 8:
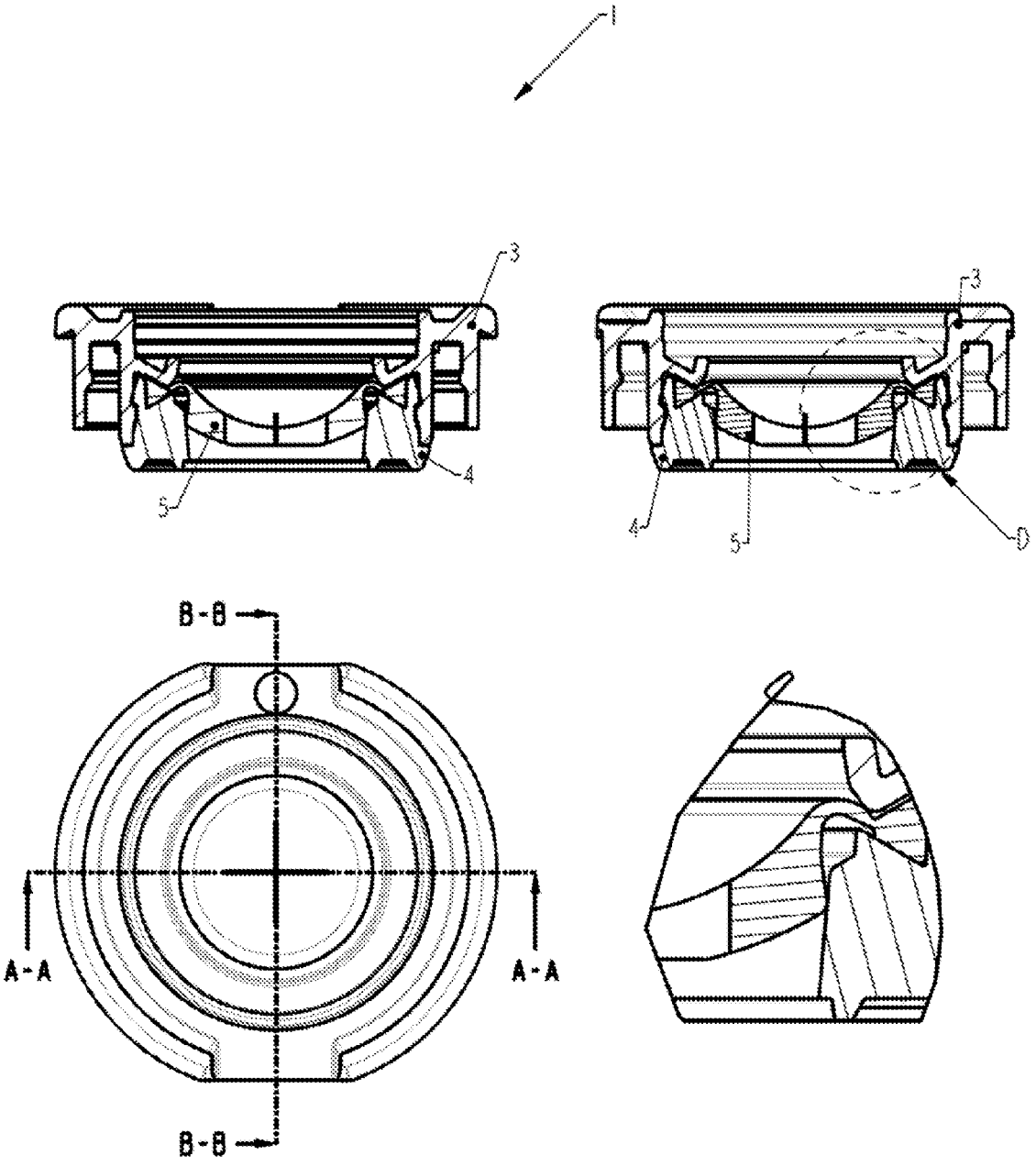
FIG. 8 are a top view and two side-sectional views in detail of the embodiment of the tap according to the present invention in STEP 2 ready to be operated.
Figure 9:
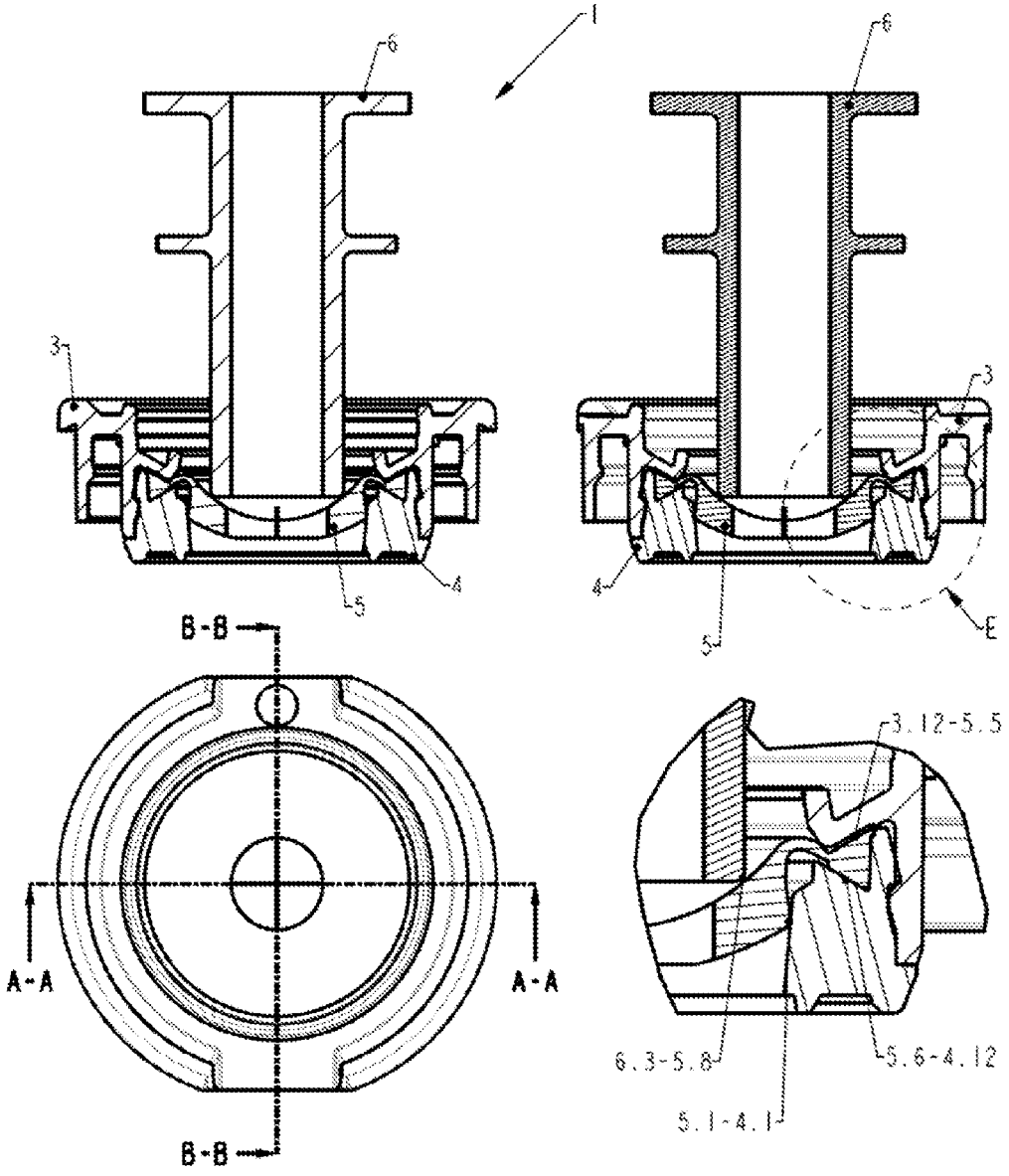
FIG. 9 is a top view and two side-sectional views in detail of the embodiment of the tap according to the present invention in STEP 3, when the dart/pin 6 comes into contact with the flexible valve 5 and the first opening phase begins.

FIG. 8 shows the inventive tap 1 ready to be activated by an external dart/pin 6 member, while FIG. 9 shows the inventive tap 1 with the dart/pin 6 approaching. In both figures, the static conditions with respect to the situation shown and described in FIG. 3 do not change. In fact, it can be noted that the flexible valve 5 is in the rest position, but with the outside in interference with the inclined wall of the lower body 4 with 5.1-4.1 as shown in FIG. 8, and this causes the valve to be "normally closed" and therefore has the flaps 5.9 of FIG. 16 perfectly sealed (not like on the prior techniques known and industrialized by the SCHOLLE, RAPAK companies or the first VITOP model or the flexible valve supplied by APTAR/LMS, which is "normally open" and does not guarantee a perfect sealing, especially in the event of a sudden increase in pressure inside the container). With this induced closure of the flaps 5.9 of FIG. 16, the guarantee is instead provided that the system will be perfectly sealed until use.

Continuing the analysis of the steps that lead to the opening and therefore to the dispensing of liquid of the inventive tap 1 by the dart/pin 6, one can see in FIG. 10 the continuous advancement of the dart/pin 6 on the flexible valve 5 by means of the thrust of the tip 6.3 of the dart/pin 6 highlighted in detail in FIG. 10, thrust that occurs on the surface 5.8, which is the internal surface of the flexible valve 5. As can be seen in FIG. 10, the flexible valve 5 extends towards the tooth 4.2 of the lower body 4 until it passes over the anchoring tooth 4.2. The flexible valve 5, being anchored stably and perimeter due to the operative joint between the main body 3 and the lower body 4 (due to the geometries 3.12-5.5 and 5.6-4.12 of FIG. 10) keeps this external perimeter area firm and stable, while item 5.3 of FIG. 10 stretches, exploiting the elasticity of the flexible material used, and allows the tip of the flexible valve 5, where the slits 5.9 are also obtained, to move easily without opening due to the interference 5.1-4.1, which grows, as the dart/pin 6 moves the tip of the valve 5 downwards, as the profile 4.1 of FIG. 15 is conical, and therefore prevents the valve from opening the flaps 5.9 until the tip of the flexible valve 5 is will have climbed, controlled by the dart/pin 6, over the anchoring edge 4.2 of FIG. 15 present on the lower body 4. Once the tip 5.2 of the flexible valve 5 has passed the tooth 4.2 of the lower body 4, then the interference on the cone 4.1 of FIG. stops acting on the tip of the flexible valve 5 (detail 5.2 of FIG. 16) and therefore the action of the interference shown on the cut edges 5.9 ends its action, and therefore allows the same edges 5.9 of the flexible valve 5 to open, allowing the dart/pin 6 to pass through the cut created on the flexible valve 5.

FIG. 11 shows the situation when the inventive tap 1 is with the dart/pin 6 fully inserted and operational, thus allowing the delivery of liquid.

Continuing with the description in FIG. 12, the configuration of the inventive tap 1 is seen once the dart/pin 6 is removed, after the first use. As it can be easily noticed, the configuration shown in FIG. 12 is completely different from the initial one shown in FIGS. 3, 7, 8 and 9. In this case, the flexible valve 5 maintains the elongation position due to the anchoring between the tooth of the lower body 4 and the external part of the flexible valve 5, as shown in detail in FIG. 12 (4.2-5.2).

The pulling force T generated by the flexible valve 5 which tries to return to its "rest" condition generates a circumferential force F which then translates, as shown schematically in FIG. 12, into vector forces F1 and F2 which keep the flaps firmly closed 5.9 of the flexible valve 5, maintaining the induced characteristic of a "normally closed" valve. This extreme advantage means that the flexible valve 5, which is preferably made of silicone, can also be made of other flexible materials. This feature is impossible to achieve without additional components from other expensive valves currently used.

The invention claimed is:

1. A tap for dispensing liquids comprising:

a main body equipped with an integrated tamper-evident ring-seal which can be A removed when opening the tap for a first time;

a lower body designed to be operatively connected to the main body;

a flexible valve located between the main body and the lower body and equipped with a central opening with slit consisting of slits or flaps, the flexible valve being designed to cooperate operationally with a dart or pin able to be inserted in the main body, in the flexible valve and in the lower body and able to engage the flexible valve to open or close the slits or flaps; and a cover cap placed above the main body and designed to protect the tap and to allow heat and aseptic treatments, the cover cap being equipped with a semi-spherical support surface designed to keep the flexible valve in its closed position and avoid opening of the flexible valve due to pressure inside the tap, wherein the flexible valve is made of silicone and is formed of an outer fastening ring which has an upper surface and a lower surface, designed to couple respectively with the surface of the body and a lower seat of the lower body, the valve having a valve zone which allows a controlled elongation and of the valve in a vertical direction, the valve also having an anchoring zone designed to mate with a tooth of the lower body, keeping the valve in an extended configuration and generating a sealing force necessary for the flaps of the flexible valve.

2. The tap of claim 1, wherein the cover cap is equipped with an integrated security seal and flexible handles.

3. The tap of claim 1, wherein the main body is additionally equipped with anchoring means for anchoring to the lower body by means of a hooking tooth and a second hooking tooth, which allow the tap to be placed at a dispensing end of a container on a connection spout, the main body being also equipped with a coupling seat designed to allow connection with the cover cap due to a ring geometry with which the cover cap is equipped.

4. The tap of claim 1, wherein the lower body is shaped with an external coupling system and a system for enabling a correct assembly, in order to stably block the flexible valve to the main body, the lower body also comprising the lower seat in order to have an anchoring abutment area that pushes the flexible valve, once assembled to the main body.

5. The tap of claim 1, wherein the lower body is also equipped with geometries which allow the internal flexible valve to move, pushed by the dart or pin, the internal flexible valve moving on an inclined plane and increasing more and more the circumferential force acting on the surfaces of the slits or flaps of the flexible valve, and the possibility consequent of the dart or pin to widen the flaps or slits and dispense liquid, once dispensing is complete and once the dart or pin has been removed, the flexible valve remaining anchored to the lower body, due to the geometries, the flexible valve being in vertical elongation, blocked by the geometries and generating a force to keep the flaps or slits sealed.

6. The tap of claim 1, wherein the main body is equipped with a vertical seat for containing the flexible valve, which allows the valve to be inserted and remain locked in the assembly position until the lower body is placed, on the main body the tamper-evident ring being also obtained, integrated in the body due to breaking jumpers, which fits stably on the top cap by means of geometries obtained on a central pin of the top ca.

7. The tap of claim 1, wherein the top cap is equipped with integrated handles and constrained by means of breaking teeth, the teeth being designed to break and free the two handles, and being able to perform a 90° overturning, which allows the end user to have a comfortable grip on the top cap in order to apply the force necessary to remove the top cap itself, which is bound to the tamper-evident ring of the main body, and to overcome the interference force that exists between the seat of the main body and the ring present on the top cap, releasing the tap from the top protection.

* * * * *